US009473837B2

(12) United States Patent
Choi et al.

(10) Patent No.: US 9,473,837 B2
(45) Date of Patent: Oct. 18, 2016

(54) SOUND TRANSDUCER WITH VENTILATION STRUCTURE

(71) Applicant: Em-Tech. Co., Ltd., Busan (KR)

(72) Inventors: Kyu Dong Choi, Gyeongsangnam-do (KR); Kil Dong Park, Busan (KR); Ji Hoon Kim, Gyeongsangnam-do (KR); Joong Hak Kwon, Gyeongsangbuk-do (KR)

(73) Assignee: Em-Tech. Co., Ltd., Busan (KR)

( * ) Notice: Subject to any disclaimer, the term of this patent is extended or adjusted under 35 U.S.C. 154(b) by 334 days.

(21) Appl. No.: 14/063,589

(22) Filed: Oct. 25, 2013

(65) Prior Publication Data

US 2014/0119592 A1 May 1, 2014

(30) Foreign Application Priority Data

Oct. 25, 2012 (KR) ..... 10-2012-0119120

(51) Int. Cl.

| | |
|---|---|
| ***H04R 1/02*** | (2006.01) |
| ***H04R 9/06*** | (2006.01) |
| ***H04R 9/02*** | (2006.01) |
| *H04R 1/28* | (2006.01) |

(52) U.S. Cl.

CPC ..... *H04R 1/02* (2013.01); *H04R 9/025* (2013.01); *H04R 9/06* (2013.01); *H04R 1/2823* (2013.01)

(58) Field of Classification Search

CPC ..... H04R 1/02; H04R 1/021; H04R 1/025; H04R 1/026; H04R 1/2823; H04R 1/2826; H04R 1/2807; H04R 1/2811; H04R 1/2819; H04R 9/025; H04R 9/027; H04R 9/041; H04R 9/045; H04R 9/06; H04R 9/022

USPC ..... 381/412

See application file for complete search history.

(56) References Cited

U.S. PATENT DOCUMENTS

| | | | | |
|---|---|---|---|---|
| 2011/0075880 | A1* | 3/2011 | Kamimura | H04R 1/06 381/413 |
| 2011/0123061 | A1* | 5/2011 | Kamimura | H04R 9/025 381/412 |
| 2014/0119591 | A1* | 5/2014 | Meng | H04R 9/02 381/386 |

FOREIGN PATENT DOCUMENTS

| | | |
|---|---|---|
| KR | 10-2011-0002370 | 1/2011 |
| KR | 10-2011-0022656 | 3/2011 |

OTHER PUBLICATIONS

Extended European Search Report for European Application No. 13004484.5 (Nov. 19, 2013).

* cited by examiner

*Primary Examiner* — Davetta W Goins
*Assistant Examiner* — Jasmine Pritchard
(74) *Attorney, Agent, or Firm* — Murphy, Bilak & Homiller, PLLC

(57) ABSTRACT

The present invention discloses a sound transducer with a ventilation structure capable of securing a flow path of air introduced from within and outside of the sound transducer to the maximum. The sound transducer with a ventilation structure includes a frame, a magnetic circuit installed within the frame, a voice coil vibrating according to mutual electromagnetic force with the magnetic circuit upon receiving an electrical signal, a vibration plate vibrating according to vibrations of the voice coil to generate a sound, and a drain hole formed to be adjacent to the corner of the frame and allowing air to flow between the interior and exterior of the frame.

19 Claims, 5 Drawing Sheets

SOUND TRANSDUCER WITH VENTILATION STRUCTURE

TECHNICAL FIELD

The present invention relates to a sound transducer, and more particularly, to a sound transducer with a ventilation structure capable of securing a flow path of air introduced from within and outside of the sound transducer to the maximum.

BACKGROUND ART

FIG. 1 is a cross-sectional view of a related art sound transducer.

As illustrated in FIG. 1, a general sound transducer (speaker) includes a frame 1, a yoke 2 insertedly installed within the frame 1, an inner magnet 3 and an outer magnet 4 transmitting magnetic flux to the yoke 2 or receiving magnetic flux from the yoke 2, respectively, an inner top plate 5 and an outer top plate 6 receiving magnetic flux from the inner magnet 3 or the outer magnet 4 and transmitting magnetic flux to a voice coil 7 at a right angle, respectively, the voice coil 7 having a portion inserted in a gap between the inner magnet 3 and the inner top plate 5 and the outer magnet 5 and the outer top plate 6, a vibration plate 8 having the voice coil 7 attached to an inner side thereof and generating vibrations according to a vertical movement of the voice coil 7, a projector 10 having a sound discharge hole 11 and protecting the vibration plate 8, and the like.

FIG. 2 is a schematic view of an enclosure in which the sound transducer is installed. As illustrated in FIG. 2, the related art sound transducer is insertedly installed in a space of an enclosure case 15. A draft hole 16 is formed on a lateral surface of the frame 1 in a longer-axis direction, and thus, when the sound transducer is inserted in the enclosure case 16, the draft hole 16 is in contact with a lateral surface of the case 15 and closed, restraining a smooth air flow. In this manner, the draft hole 16 of the related art sound transducer is formed in the longer side of the frame or in the vicinity of the center of a cross-section of the frame 1.

In the case of the structure, a size (or a sectional area) of a magnetic circuit based on the yoke 2 and the outer magnet 4 is required to be reduced due to the formation position of the draft hole 16.

DISCLOSURE OF THE INVENTION

An object of the present invention is to provide a sound transducer with a ventilation structure capable of increasing a degree of ventilation between an inner space and an outer space thereof or a degree of ventilation between an ambient space thereof and a resonance space of an enclosure.

Another object of the present invention is to provide a sound transducer with a ventilation structure capable of maximizing a magnetic circuit in size, while maintaining a ventilation space.

Another object of the present invention is to provide a sound transducer with a ventilation structure capable of forming a smooth air flow between the sound transducer and an inner space of a different device when the sound transducer is installed in the difference device.

Another object of the present invention is to provide a sound transducer with a ventilation structure capable of preventing an introduction of foreign objects through the ventilation structure.

According to an aspect of the present invention for achieving the above objects, there is provided a sound transducer with a ventilation structure, including: a frame; a magnetic circuit installed within the frame; a voice coil vibrating according to mutual electromagnetic force with the magnetic circuit upon receiving an electrical signal; a vibration plate vibrating according to vibrations of the voice coil to generate a sound; and a drain hole formed to be adjacent to the corner of the frame and allowing air to flow between the interior and exterior of the frame.

The drain hole may be formed in a position adjacent to the corner of the frame, relative to the center of a lateral surface of the frame in a longer axis direction.

The drain hole may be formed in a space between a yoke included in the magnetic circuit and the corner of the frame.

The yoke may include a longer side portion, a shorter side portion, and a connection portion connecting the longer side portion and the shorter side portion, and the drain hole may be formed in a space between the connection portion and the corner of the frame.

A horizontal blocking portion may be formed on an upper surface of the drain hole, and a lateral surface and a lower surface of the drain hole may be formed by a vertical blocking portion and a lateral surface of the frame.

A terminal unit formed to be stepped with respect to the horizontal blocking portion may be formed between the vertical blocking portion and the corner of the frame.

The horizontal blocking portion may be formed to be stepped with respect to the yoke.

A sloped portion may be formed between a lateral surface or the corner of the frame and the yoke.

A portion of the horizontal blocking portion may be formed inwardly, relative to a lateral portion of the frame, to allow a portion of the drain hole to face in an upward direction.

The longer side portion and the shorter side portion may have a linear shape, and the connection portion may have a round shape or may have a linear shape at a predetermined angle with respect to the longer side portion and the shorter side portion.

According to an embodiment of the present invention, a degree of ventilation between an inner space and an outer space of the sound transducer or a degree of ventilation between a peripheral space of the sound transducer and a resonance space of an enclosure can be increased.

Also, according to an embodiment of the present invention, since the magnetic circuit is maximized in size, while maintaining a ventilation space, sound pressure characteristics can be enhanced.

Also, according to an embodiment of the present invention, when the sound transducer is installed within a different device, the sound transducer can make air flow smoothly between the sound transducer and an inner space of the different device.

Also, according to an embodiment of the present invention, an introduction of foreign objects through the ventilation structure can be prevented.

BEST MODE FOR CARRYING OUT THE INVENTION

Hereinafter, a sound transducer with a ventilation structure according to an embodiments of the present invention will be described with reference to the accompanying drawings.

Figure 1:
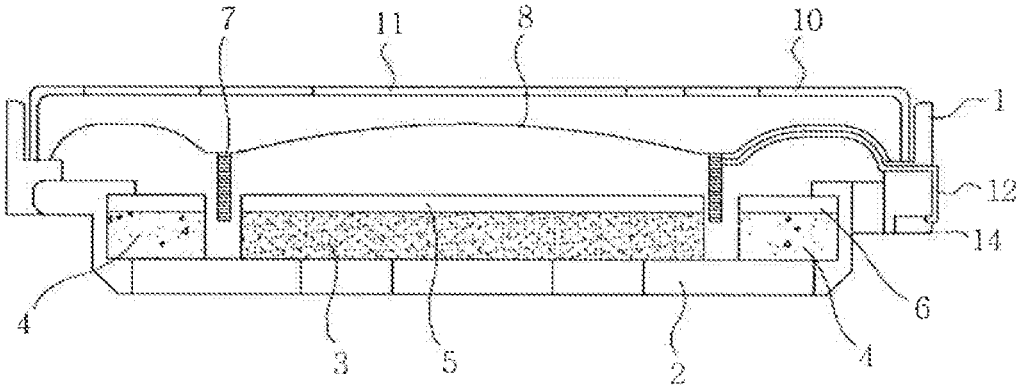
FIG. 1 (PRIOR ART)
FIG. 1 is a cross-sectional view of a related art sound transducer.
Figure 2:
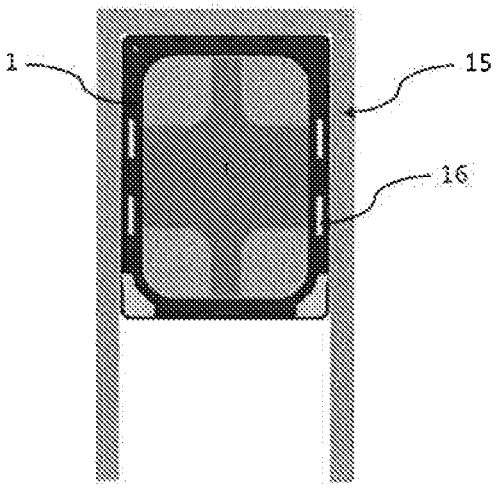
FIG. 2 (PRIOR ART)
FIG. 2 is a schematic view of an enclosure in which the sound transducer of FIG. 1 is installed.
Figure 3:
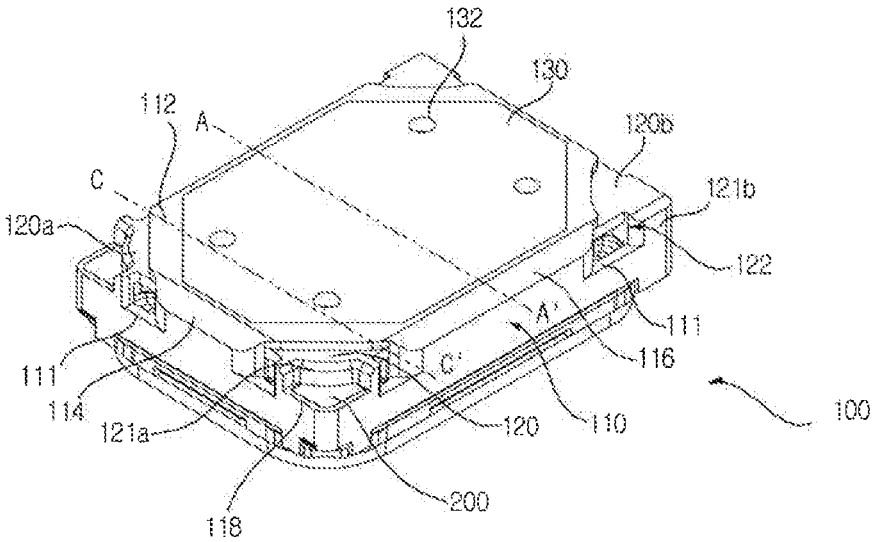
FIG. 3 is a perspective view of the sound transducer with a ventilation structure according to an embodiment of the present invention.
Figure 4:
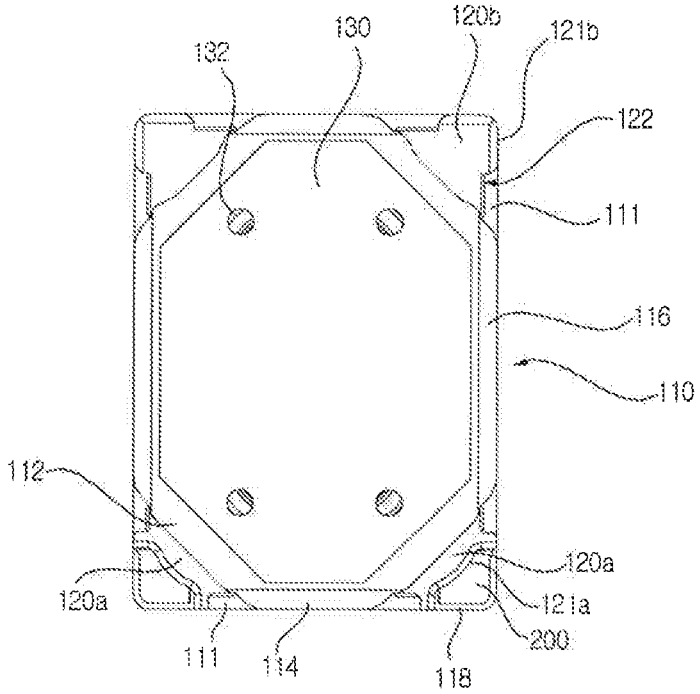
FIG. 4 is a plan view of the sound transducer of FIG. 3.
Figure 5:
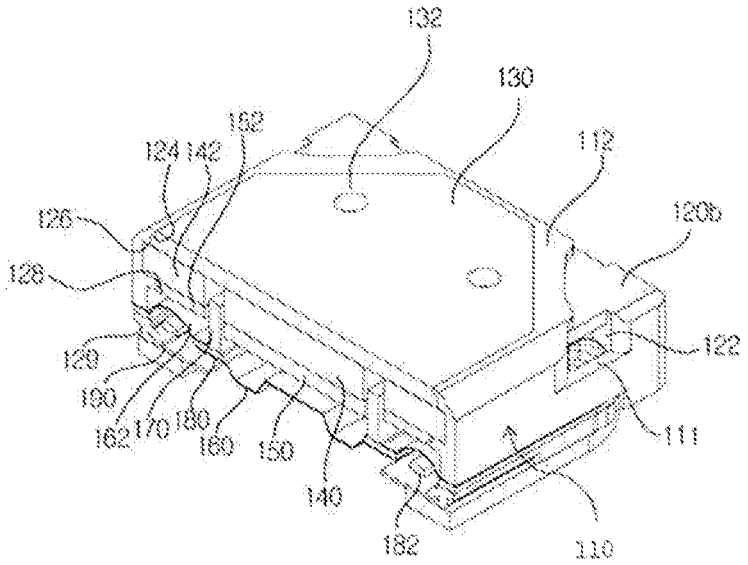
FIG. 5 is a cross-sectional perspective view taken along line A-A' of FIG. 3.
Figure 6:
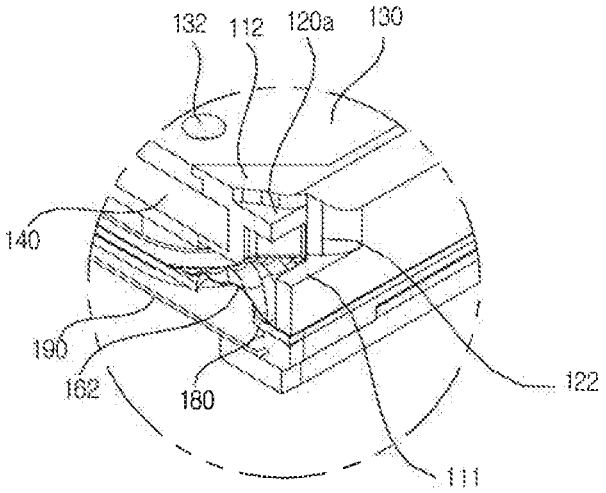
FIG. 6 is a partial cross-sectional perspective view taken along line C-C' of FIG. 3.

FIG. 3 is a perspective view of the sound transducer with a ventilation structure according to an embodiment of the present invention, FIG. 4 is a plan view of the sound transducer of FIG. 3, FIG. 5 is a cross-sectional perspective view taken along line A-A' of FIG. 3, and FIG. 6 is a partial cross-sectional perspective view taken along line C-C' of FIG. 3.

In FIG. 3, a sound transducer is illustrated as being reversed to describe a part having a ventilation structure in detail. The sound transducer 100 includes a frame 110, a yoke 130 installed on top of the frame 110, and a drain hole 122 formed in the corner of the frame 110.

The frame 110 includes a first sloped portion 112 in contact with the yoke 130 to correspond to a shape of the yoke 130 and sloped toward the corner of the frame between the yoke 130 and the corner of the frame 110, a second sloped portion 114 corresponding to the shape of the yoke and sloped toward a shorter side of the frame 110 between the yoke 130 and a lateral surface of the frame 110, and a third sloped portion 116 corresponding to the shape of the yoke and sloped toward a longer side of the frame 110 between the yoke 130 and a lateral surface of the frame 110.

Also, the drain hole 122 is formed on a laterals surface of the frame 110 in a lower portion of the first sloped portion 112 of the frame 110. The frame 110 includes a first horizontal blocking portion 120*a* formed to be lower than the yoke 130 and/or the first sloped portion, namely, formed to be stepped, between the first sloped portion 112 and the corner of the frame 110 to prevent foreign objects, or the like, from an upper side from being introduced to the drain hole 122, and a first vertical blocking portion 121*a* connected to the first horizontal blocking portion 120*a* in the corner of the frame 110 or between the first horizontal blocking portion 120*a* and the corner of the frame 110 to prevent foreign objects, or the like, from the corner (or in a lateral direction) from being introduced to the drain hole 122. A pair of drain holes 122 are formed to be adjacent to each corner. The pair of drain holes 122 are connected to allow air to flow in different directions between the first horizontal blocking portion 120*a* formed on an upper surface, the first vertical blocking portion 121*a* formed on the lateral surface, and a lateral portion 111 of the frame 110 formed on the lateral surface and a lower surface. The frame 110 includes a terminal fixing portion 118 formed to be lower than the first horizontal blocking portion 120*a*, namely, formed to be stepped, in the corner of the frame or between the first vertical blocking portion 121*a* and the corner of the frame 110, and connected to the first vertical blocking portion 121*a* to fix a terminal 200. The terminal 200 is an element electrically connected to an element that transmits a conductor or any other electrical signal from an electronic device, and a soldering operation, or the like, is performed on an upper surface of the terminal 200. In this case, in order to prevent foreign objects, or the like, from being inserted into the drain hole 122 during the soldering operation, the first vertical blocking portion 121*a* is formed to surround the terminal 200 and connect the lateral surface of the frame 110 in the longer-axis direction and the lateral surface of the frame 110 in the shorter-axis direction which are adjacent to each other.

Also, the drain hole 122 is formed on a lateral surface of the frame 110 in a lower portion of the first sloped portion 112 of the frame, in a corner region in which the terminal 200 is not formed, namely, in a region facing the region in which the terminal 200 is formed. The frame 110 includes a second horizontal blocking portion 120*b* formed to be lower than the yoke 130 and/or the first sloped portion 112, namely, formed to be stepped, between the first sloped portion 112 and the corner of the frame 110 to prevent foreign objects, or the like, from an upper side from being introduced to the drain hole 122, and a second vertical blocking portion 121*b* connected to the second horizontal blocking portion 120*b* in the corner of the frame 110 or between the second horizontal blocking portion 120*b* and the corner of the frame 110 to prevent foreign objects, or the like, from the corner (or in the lateral direction) from being introduced to the drain hole 122. A pair of drain holes 122 are formed to be adjacent to each corner. The pair of drain holes 122 are connected to allow air to flow in different directions between the second horizontal blocking portion 120*b* formed on the upper surface, the second vertical blocking portion 121*b* formed on the lateral surface, and the lateral portion 111 of the frame 110 formed on the lateral surface and the lower surface.

As illustrated in FIG. 4, the yoke 130 is installed on the frame 110, and the drain hole 122 is formed in the vicinity of the frame 110. Also, a through hole 132 is formed in the yoke 130, and a voice coil 170 is installed below the through hole 132. The through hole 132 is formed in the yoke 130 in a space in which the voice coil 170 is installed between an inner magnet 140 and an outer magnet 142 to serve as a drain hole.

As illustrated in FIG. 5, the sound transducer 100 includes the yoke 130, the inner magnet 140 and the outer magnet 142 transmitting magnetic flux to the yoke 130 or receiving magnetic flux from the yoke 130, respectively, an inner top plate 150 and an outer top plate 152 receiving magnetic flux from the inner magnet 140 or the outer magnet 142 and transmitting the received magnetic flux to the voice coil 170 at a right angle, respectively, the voice coil 170 having a portion inserted in a gap between the inner magnet 140 and the inner top plate 150 and the outer magnet 142 and the outer top plate 152, a vibration plate vibrating according to vibrations of the voice coil 170 to generate a sound, and including a central vibration plate 160 and a side vibration plate 152, a suspension transmitting an electrical signal to the voice coil 170 and regulating vibrations of the vibration plate, a substrate 180 (e.g., a flexible printed circuit board (FPCB)), electrically connected to the terminal 200 that receives an electrical signal from an external terminal, and a protector 190 protecting components of the sound transducer.

In the frame 110, a magnetic circuit including the yoke 130, the inner and outer magnets 140 and 142, and the inner and outer top plates 150 and 152 is installed in the center thereof. Thus, an empty space is provided in the center of the frame 110 to allow the magnetic circuit to be installed therein. The magnetic circuit is installed within the frame 110 to maintain constant magnetic force in the space in which the voice coil 170 is positioned.

The frame 110 includes a yoke installation portion 124 in which the yoke 130 is fixedly installed, a magnet installation portion 126 in which the outer magnet 142 is fixedly installed, and a top plate installation portion 128 in which the outer top plate 152 is fixedly installed. The substrate 180 is insertedly installed in the lateral surface of the frame 110, and a protector fixing unit 129 in which the projector 190 is fixedly installed is formed.

A vibration member in which the voice coil, 170, the vibration plate, and the substrate 180 are attached to each other is installed on the frame 110. The voice coil 170 is attached to an upper portion of the substrate 180, and the side vibration plate 162 is attached to be spaced apart from the portion of the frame 170 to which the voice coil is attached. Also, the central vibration plate 160 is attached to a lower portion of the substrate 180. The sound transducer is a device including the magnetic circuit and the vibration member formed within the frame 110 and in which the vibration member vibrates according to an electrical signal applied from the outside to generate a sound.

The voice coil 170 is bonded to the suspension unit 182 through a method such as soldering, or the like, and attached to the suspension unit 182 by a tape or any other adhesive. The suspension unit 182 allows the vibration plate to vibrate only in a vertical direction, preventing an occurrence of abnormal vibration such as divided vibration or partial vibration, thereby enhancing sound quality. The vibration plate includes the central vibration plate 160 positioned in a central portion and the side vibration plate 162 positioned in an outer portion of the central vibration plate 160 and having an annular shape. The central vibration plate 160 has a downwardly protruded dome-like shape, and the side vibration plate 162 has an upwardly protruded dome-like shape.

FIG. 6 is a partial cross-sectional perspective view taken along line C-C' of FIG. 3. As illustrated in FIG. 6, the second horizontal blocking portion 120*b* prevents an introduction of foreign objects from an upper side, and the lateral portion 111 of the frame 110 prevents an introduction of foreign objects in the lateral surface. Accordingly, an air flow rises from an upper side of the vibration plate 162 along the inner side of the lateral portion 111 and moves to the outside through the drain hole 122.

Figure 7:
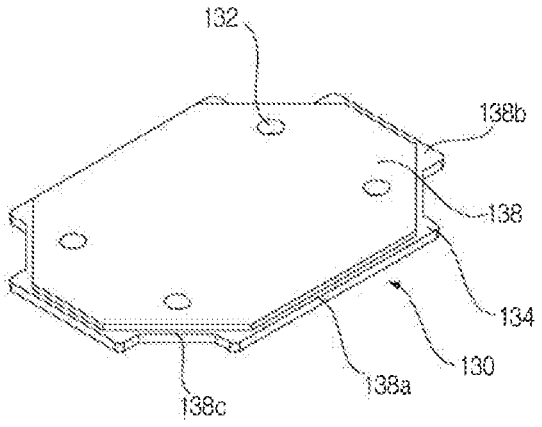
FIG. 7 is a perspective view of a yoke 130 of FIG. 3.

FIG. 7 is a perspective view of a yoke 130 of FIG. 3. The yoke 130 illustrated in FIG. 7 includes a rim portion 134 insertedly fixed to the frame 110 and a base portion 138 positioned within the rim portion 134 and exposed to the outside of the frame 110. The base portion 138 includes a longer axis portion 138*a* formed in a longer axis direction, a shorter axis portion 138*b* formed in a shorter axis direction, and a connection portion 138*c* connecting the longer axis portion 138*a* and the shorter axis portion 138*b*. The longer axis portion 138*a* is consistent with the longer axis direction of the frame 110 and has a linear shape, and the shorter axis portion 138*b* is consistent with the shorter axis direction and has a linear shape. As illustrated, the connection portion 138*c* may be chamfered to have a linear shape so as to be connected to the longer axis portion 138*a* and the shorter axis portion 138*b* at an angle smaller than 180 degrees. Alternatively, the connection portion 138*c* may be processed to be rounded to have a round shape. As illustrated, the connection portions 138*c* may be formed to correspond to four corners of the frame 110, or at least two or more connection portions 138*c* may be formed.

Also, in order to correspond to the shape of the yoke 130, shapes of the outer magnet 142 and the outer top plate 152 should be altered.

Referring to FIGS. 4 and 7, the drain hole 122 is formed to be adjacent to the corner of the frame 110, rather than to the center of the lateral surface of the frame 110 in the longer axis direction. In particular, the drain hole 122 is formed in a space between the yoke 130 and the corner of the frame 110, allowing the magnetic circuit to have a maximum size. In particular, the drain hole 122 is formed in a space between a front side of the connection portion 138*c* and the corner of the frame 110.

Referring to FIGS. 3 and 4, portions of the first and second horizontal blocking portions 120*a* and 120*b* constituting an upper portion of the through hole 122 are formed inwardly, relative to the lateral surface of the frame 110. Accordingly, a portion of the through hole 122 faces in an upward direction of the frame 110, allowing air to flow even in the upward direction of the frame 110, as well as to the lateral surface of the frame 110. Referring to FIG. 4, a portion of the drain hole 122 is seen in the plan view of the sound transducer 100.

Figure 8:
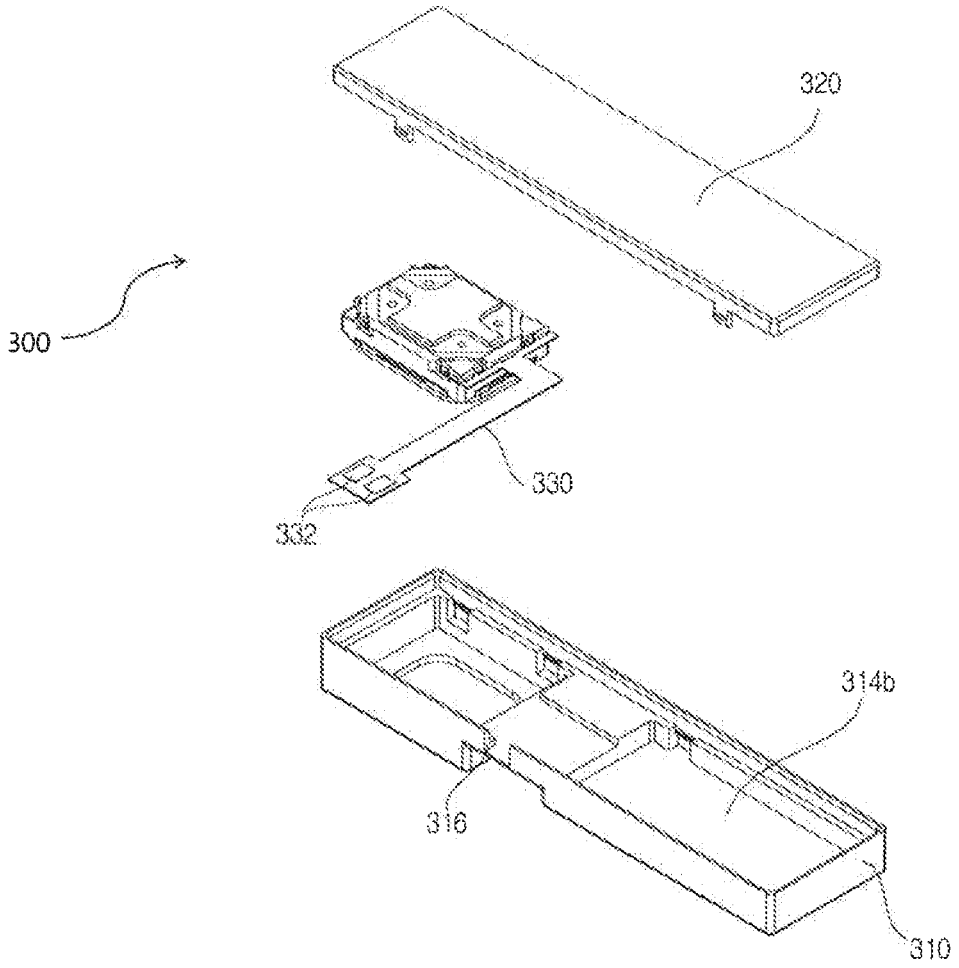
FIG. 8 is an exploded perspective view illustrating the sound transducer of FIG. 3 and an enclosure.
Figure 9:
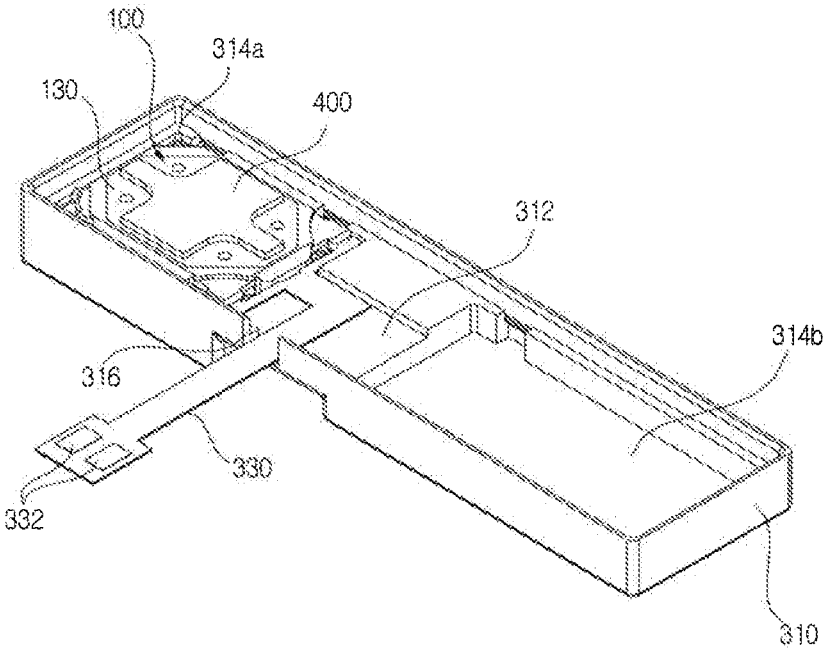
FIG. 9 is an assembled perspective view illustrating the sound transducer of FIG. 8 and the enclosure.

FIG. 8 is an exploded perspective view illustrating the sound transducer of FIG. 3 and an enclosure, and FIG. 9 is an assembled perspective view illustrating the sound transducer of FIG. 8 and the enclosure.

An enclosure 300 includes a pair of accommodation recesses 314*a* and 314*b* allowing the sound transducer 100 to be insertedly installed therein, or maintained as being empty, a connection portion 316 connecting the pair of accommodation recesses 314*a* and 314*b* and allowing an FPCB connection portion 330 to be placed thereon, a case 310 having a through recess 316 allowing the FPCB connection portion 330 to penetrate therethrough outwardly, and an upper cover 320 covering a resonance space within the enclosure case 310. The accommodation recess 314*b*, in which the sound transducer 100 is not inserted, is a resonance space.

A lateral surface of the frame 110 of the sound transducer 100 is installed to be in contact with a lateral surface of the accommodation recess 314*a*.

The FPCB connection portion 330 includes a pair of reception terminals 332 receiving an electrical signal from an electrical device and a pair of pattern portions (not shown) electrically connecting the pair of terminals 200 of the sound transducer 100 and the reception terminals 332.

When the sound transducer 100 is insertedly installed in the enclosure case 310, a buffering member 400 may be coupled to an upper surface and/or lower surface of the frame 110.

As for an air flow, air passing through the drain hole 122 flows to a front side of the lateral surface of the frame 110 and a portion thereof moves upwardly. Subsequently, air moves along an upper surface of the second horizontal blocking portion 120*b* toward the resonance space through an upper surface of the sloped portion 116 or 112. Also, air moves along an upper surface of the first horizontal blocking portion 120*a* or the sloped portion 112 toward the resonance space.

Also, a degree of air flow (a degree of ventilation) between the inner space of the sound transducer 100 and an outer space as the resonance space within the enclosure case 310 can be enhanced through the drain hole 122 formed in the sound transducer 100.

As described above, the enhancement of an air flow between the interior of the sound transducer 100 and the outer space through the drain hole 122 and the through hole 132 has been known to improve wideband sound pressure characteristics following a primary resonance band (e.g., 1~4 kHz) of the sound transducer 100 (please see pages 115 to 122, third issue (No.3), volume 26, article of The Acoustical Society of Korean, 2007).

In an embodiment of the present invention, air can flow smoothly between the interior of the sound transducer 100 and an outer space without reducing a size of the magnetic circuit of the sound transducer 100.

While the present invention has been shown and described in connection with the embodiments, it will be apparent to those skilled in the art that modifications and variations can be made without departing from the spirit and scope of the invention as defined by the appended claims.

What is claimed is:

1. A sound transducer with a ventilation structure, the sound transducer comprising:

a frame;

a magnetic circuit installed within the frame, including a yoke, inner and outer magnets, and inner and outer top plates;

a voice coil vibrating according to mutual electromagnetic force with the magnetic circuit upon receiving an electrical signal;

a vibration plate vibrating according to vibrations of the voice coil to generate a sound; and a drain hole formed to be adjacent to a corner of the frame and allowing air to flow between the interior and exterior of the frame, wherein the drain hole is formed in a space between the yoke and the outer magnet included in the magnetic circuit and the corner of the frame.

2. The sound transducer as claimed in claim 1, wherein the drain hole is formed in a position adjacent to the corner of the frame, relative to the center of a lateral surface of the frame in a longer axis direction.

3. The sound transducer as claimed in claim 1, wherein the yoke comprises a longer side portion, a shorter side portion, and a connection portion connecting the longer side portion and the shorter side portion, and the drain hole is formed in a space between the connection portion and the corner of the frame.

4. The sound transducer as claimed in claim 1, wherein a horizontal blocking portion is formed on an upper surface of the drain hole, and a lateral surface and a lower surface of the drain hole are formed by a vertical blocking portion and a lateral surface of the frame.

5. The sound transducer as claimed in claim 2, wherein a horizontal blocking portion is formed on an upper surface of the drain hole, and a lateral surface and a lower surface of the drain hole are formed by a vertical blocking portion and a lateral surface of the frame.

6. The sound transducer as claimed in claim 1, wherein a horizontal blocking portion is formed on an upper surface of the drain hole, and a lateral surface and a lower surface of the drain hole are formed by a vertical blocking portion and a lateral surface of the frame.

7. The sound transducer as claimed in claim 3, wherein a horizontal blocking portion is formed on an upper surface of the drain hole, and a lateral surface and a lower surface of the drain hole are formed by a vertical blocking portion and a lateral surface of the frame.

8. The sound transducer as claimed in claim 4, wherein a terminal unit formed to be stepped with respect to the horizontal blocking portion is formed between the vertical blocking portion and the corner of the frame.

9. The sound transducer as claimed in claim 6, wherein a terminal unit formed to be stepped with respect to the horizontal blocking portion is formed between the vertical blocking portion and the corner of the frame.

10. The sound transducer as claimed in claim 7, wherein a terminal unit formed to be stepped with respect to the horizontal blocking portion is formed between the vertical blocking portion and the corner of the frame.

11. The sound transducer as claimed in claim 4, wherein the horizontal blocking portion is formed to be stepped with respect to the yoke.

12. The sound transducer as claimed in claim 7, wherein the horizontal blocking portion is formed to be stepped with respect to the yoke.

13. The sound transducer as claimed in claim 1, wherein a sloped portion is formed between a lateral surface or the corner of the frame and the yoke.

14. The sound transducer as claimed in claim 1, wherein a sloped portion is formed between a lateral surface or the corner of the frame and the yoke.

15. The sound transducer as claimed in claim 3, wherein a sloped portion is formed between a lateral surface or the corner of the frame and the yoke.

16. The sound transducer as claimed in claim 4, wherein a portion of the horizontal blocking portion is formed inwardly, relative to a lateral portion of the frame, to allow a portion of the drain hole to face in an upward direction.

17. The sound transducer as claimed in claim 6, wherein a portion of the horizontal blocking portion is formed inwardly, relative to a lateral portion of the frame, to allow a portion of the drain hole to face in an upward direction.

18. The sound transducer as claimed in claim 7, wherein a portion of the horizontal blocking portion is formed inwardly, relative to a lateral portion of the frame, to allow a portion of the drain hole to face in an upward direction.

19. The sound transducer as claimed in claim 3, wherein the longer side portion and the shorter side portion have a linear shape, and the connection portion has a round shape or a linear shape at a predetermined angle with respect to the longer side portion and the shorter side portion.

* * * * *